US007329087B2

(12) United States Patent
Cairo et al.

(10) Patent No.: US 7,329,087 B2
(45) Date of Patent: Feb. 12, 2008

(54) SEAL-LESS CMC VANE TO PLATFORM INTERFACES

(75) Inventors: Ronald Ralph Cairo, Greer, SC (US); Nitin Bhate, Rexford, NY (US)

(73) Assignee: General Electric Company, Schenectady, NY (US)

( * ) Notice: Subject to any disclaimer, the term of this patent is extended or adjusted under 35 U.S.C. 154(b) by 39 days.

(21) Appl. No.: 11/228,251

(22) Filed: Sep. 19, 2005

(65) Prior Publication Data

US 2007/0065285 A1 Mar. 22, 2007

(51) Int. Cl.
*F01D 9/04* (2006.01)

(52) U.S. Cl. ..... 415/135; 415/200; 415/209.4; 415/210.1

(58) Field of Classification Search ..... 415/135–139, 415/189–190, 208.1, 208.2, 209.2, 209.3, 415/209.4, 210.1, 200
See application file for complete search history.

(56) References Cited

U.S. PATENT DOCUMENTS

| | | | | |
|---|---|---|---|---|
| 4,326,835 | A | 4/1982 | Wertz | |
| 5,630,700 | A * | 5/1997 | Olsen et al. | 415/135 |
| 5,704,762 | A | 1/1998 | Schultze | |
| 6,000,906 | A * | 12/1999 | Draskovich | 415/209.4 |
| 6,409,473 | B1 * | 6/2002 | Chen et al. | 415/209.4 |
| 6,464,456 | B2 * | 10/2002 | Darolia et al. | 415/209.2 |
| 7,052,234 | B2 * | 5/2006 | Wells et al. | 415/137 |

* cited by examiner

*Primary Examiner*—Christopher Verdier
(74) *Attorney, Agent, or Firm*—Nixon & Vanderhye, PC

(57) ABSTRACT

A stator vane assembly for a gas turbine includes a ceramic matrix composite airfoil held between radially inner and outer metal platforms wherein an interface between the airfoil and at least one of the radially inner and outer platforms is shaped to create a circuitous leakage path for gas from the gas turbine hot gas path.

19 Claims, 4 Drawing Sheets

SEAL-LESS CMC VANE TO PLATFORM INTERFACES

BACKGROUND OF THE INVENTION

This invention relates generally to turbine nozzle assemblies and specifically, to platform interface configurations for stage 2 CMC nozzle vanes.

Sealing between high temperature components such as ceramic matrix composite (CMC) nozzle vanes and radially inner and outer metallic attachments or platforms creates problems relating to steep thermal gradients with associated high thermal stresses and reduced component life; internal pressure due to cooling air resulting in air flow wall distortion; and time varying performance erosion due to historical seal degradation. Eliminating the seal between a CMC vane and metal inner and outer platforms, however, results in an open channel for hot gas ingestion. Accordingly, there remains a need for a new geometry at the interface of the CMC vane and either one or both of the radially inner and outer metallic platforms that accommodates the inherent difficulties in the matching of ceramic and metal components, and that also eliminates the need for separate and discrete sealing elements. Seal-less design is also synonymous with unpressurized vane design.

BRIEF DESCRIPTION OF THE INVENTION

Controlled leakage is the key to the success of a seal-less design. Controlled leakage can be accommodated by creative interface configurations on the platform interface surface, the vane interface surface, or both. In the exemplary embodiments of this invention, creative interface configurations are provided that establish a circuitous gas leak path for increased flow resistance, resulting in the desired controlled leakage.

In the various embodiments described herein, a CMC stator vane (also referred to herein as an airfoil shell or, simply airfoil) is assembled between a pair of radially inner and outer metal platforms that may be radially interconnected by a pair of spars extending through the airfoil shell. Each of the platforms is formed on its interior face with an airfoil-shaped recess adapted to receive the CMC airfoil shell. The seal-less configurations described herein are located on the airfoil shell and/or on adjacent interior peripheral surfaces of the airfoil-shaped recesses on the inner and/or outer platforms.

In one exemplary embodiment, mating step joints are formed on the peripheral surface of each platform recess and the respective adjacent airfoil shell surfaces.

In a second exemplary embodiment, the interface configuration is in the form of a scarf joint, i.e., with mating angled surfaces extending about the adjacent peripheries of each platform recess and respective airfoil shell surface.

In a third exemplary embodiment, the platform airfoil surfaces are formed with a plurality of laterally projecting, abradable knife edges that interface with adjacent smooth surfaces on the airfoil shell.

In a fourth exemplary embodiment, a compliant or spring interface is provided on the peripheral surface of each platform recess for engagement with a respective smooth surface on the adjacent airfoil shell. It will be appreciated that the free end or edge surface of the compliant interface may also be formed with a step joint or scarf joint as described above, to interface with the adjacent mating surface on the respective airfoil shell to provide the desired circuitous or tortuous path.

Accordingly, in one aspect, the present invention relates to a stator vane assembly for a gas turbine comprising a ceramic matrix composite airfoil held between radially inner and outer metal platforms wherein an interface between the airfoil and at least one of the radially inner and outer platforms is shaped to create a circuitous leakage path for gas from the gas turbine hot gas path.

In another aspect, the invention relates to a stator vane assembly for a gas turbine comprising a ceramic matrix composite airfoil held between radially inner and outer metal platforms wherein each of the platforms is formed with a recess adapted to receive the inner and outer platforms, each recess including a peripheral edge, the peripheral edge shaped to create the circuitous leakage path in cooperation with an adjacent surface on the airfoil.

In still another aspect, the invention relates to a stator vane assembly for a gas turbine comprising a ceramic matrix composite vane held between radially inner and outer metal platforms wherein an interface between the vane and at least one of the radially inner and outer platforms is shaped to provide a compliant face for engagement with a smooth surface on the vane.

The invention will now be described in detail in connection with the drawings identified below.

DETAILED DESCRIPTION OF THE INVENTION

Figure 1:
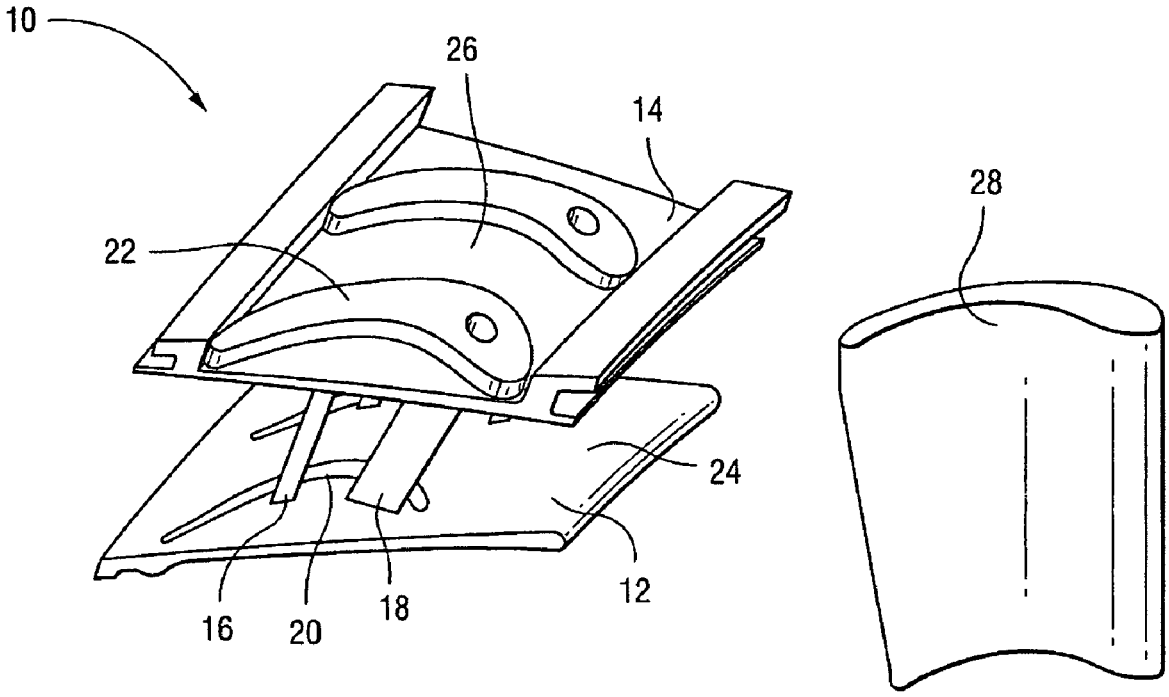
FIG. 1 is a perspective exploded view of a CMC airfoil shell and associated inner and outer metal platforms connected by radial spars.

With reference to FIG. 1, a CMC airfoil shell and metal platform assembly 10 is shown in exploded form. More specifically, a pair of radially inner and outer metal platforms 12, 14 are interconnected by a pair of radial spars 16, 18. A pair of airfoil-shaped recesses 20, 22 are formed in the metal platform surfaces 24, 26, respectively, with the open sides of the recesses facing each other. In the exemplary embodiment, the larger spar 18 is in the shape of a hollow channel that supplies cooling air to the airfoil shell 28. In this regard, the airfoil shell 28 is a hollow member that can be slidably received over the spars during assembly, with opposite ends of the airfoil shell received in the recesses 20, 22. Note that in the exemplary embodiment, the platforms 12, 14 are each formed with two recesses such that a pair of adjacent airfoil shells may be supported between the inner and outer platforms.

In an alternative arrangement, the spars 16, 18 could be combined into a single airfoil-shaped channel, sized to also receive the external airfoil shell 28 in telescoping relationship, with appropriate dimensional tolerances.

As illustrated in FIG. 1, the recesses 20, 22 are shaped in a manner complementary to the airfoil shell 28. It will be appreciated that the tolerances between the airfoil shell and the platform recesses must be controlled to avoid harmful excessive vibration, but at the same time, avoid problems associated with thermal mismatch between the components.

Figure 2:
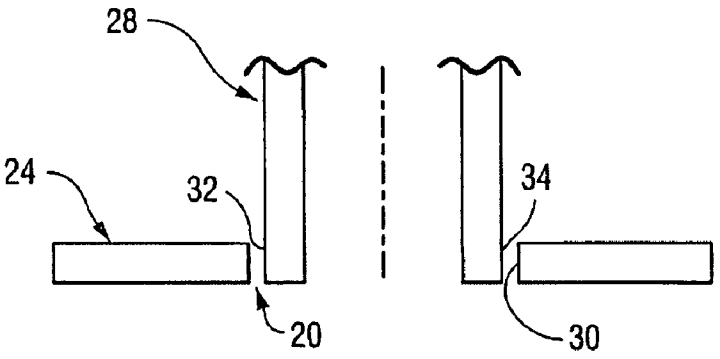
FIG. 2 is a schematic of a baseline or reference configuration at the interface of a CMC airfoil shell and a radially inner metal platform.

Turning to FIG. 2, the airfoil shell 28 is schematically represented as seated in the airfoil-shaped recess 20 of the inner metal platform 24. The recess 20 is defined by the closed peripheral edge 30 that interfaces with surfaces 32, 34 on the pressure and suction sides of the airfoil shell 28. This illustration provides a baseline reference for the interface configurations described below. In this regard, the unique interface configurations described herein are formed at the interface between recess surface 30 and opposed surfaces 32, 34 of the airfoil shell at the radially inner platform 24, and/or substantially identically at the radially outer platform 14. For convenience, only the interfaces at the radially inner platforms are shown.

Figure 3:
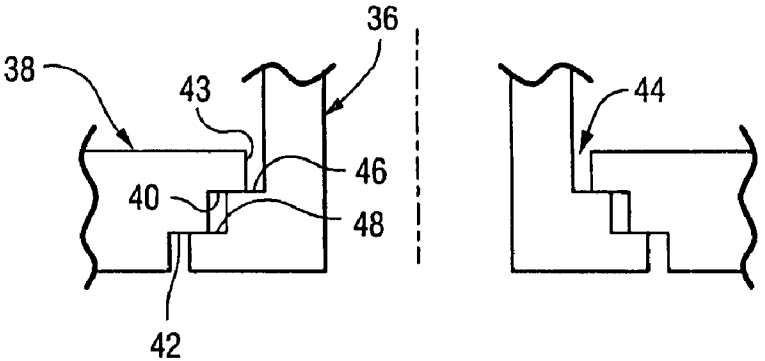
FIG. 3 is a schematic of a step joint interface between a CMC airfoil shell and an inner metal platform in accordance with a first exemplary embodiment of the invention.

With reference now to FIG. 3, the CMC airfoil shell 36 is shown in assembled relationship with an inner metal platform 38. In this example, the interface configuration (or simply interface) is in the form of a step joint, with at least two, laterally oriented steps 40, 42, oriented perpendicular to a radial centerline through the vane, formed in the peripheral edge 43 of the lower platform recess 44 engaged with lateral shoulders 46, 48 formed at the lower end of the airfoil shell 36. Note that this arrangement allows the insertion of the airfoil shell from below the lower platform 38. The step joint at the opposite end of the airfoil shell would be reversed, however, to permit one-way installation of the shell 36 between both the inner and outer platforms. With appropriate tolerances between the interfacing surfaces, it will be appreciated that any gas leaking out of the hot gas path of the turbine, will necessarily be forced to follow a circuitous route through the interface, establishing the desirable controlled leakage, and without having to use discrete sealing elements.

Figure 4:
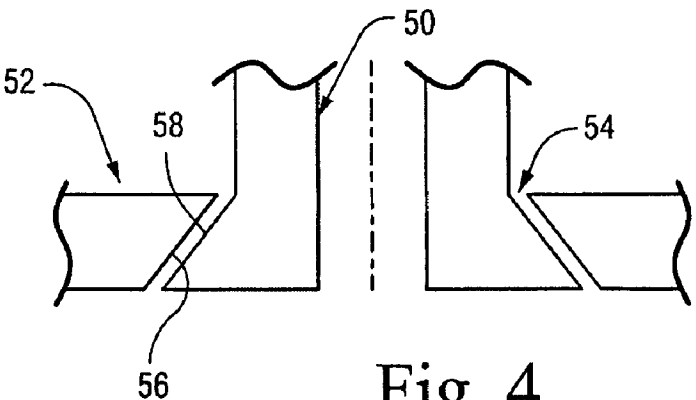
FIG. 4 is a schematic of a scarf joint interface between a CMC airfoil shell and an inner metal platform in accordance with a second exemplary embodiment of the invention.

With reference now to FIG. 4, another interface is illustrated that is of simpler design than the configuration in FIG. 3. Specifically, a CMC airfoil shell 50 is shown in assembled relationship with respect to an inner metal platform 52. In this embodiment, the radially inner platform recess 54 is formed with a peripheral edge surface 56 that is slanted at about a 45° angle to a radial centerline through the airfoil shell 50. At the same time, the lower surface 58 of the airfoil shell 50 is formed at a similar angle, thus forming a scarf joint between the airfoil shell and the inner platform 52. Here again, for purposes of facilitating one-way installation, the interface at the upper end of the airfoil shell would be reversed.

Figure 5:
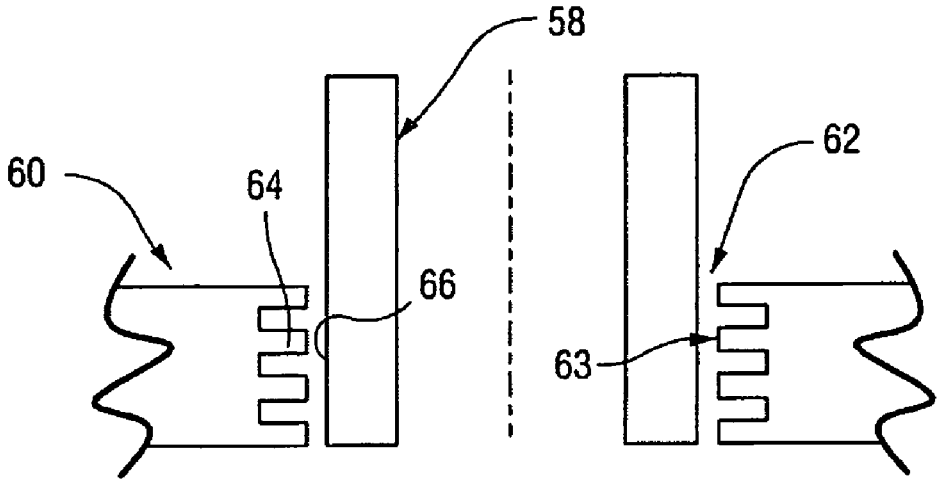
FIG. 5 is a schematic of an abradable knife edge interface between a CMC airfoil shell and an inner metal platform in accordance with a third exemplary embodiment of the invention.

In FIG. 5, yet another embodiment is shown where a CMC airfoil shell 58 is seated within the recess 62 in the inner metal platform 60. In this embodiment, the recess 62 in the platform 60 is formed with a peripheral edge 63 made up of a plurality (for example, at least four) of inwardly projecting abradable knife edges 64 (four shown), spaced from each other in the radial direction. The edges 64 interface with an adjacent smooth surface 66 on the airfoil shell 58, with appropriate tolerance between the two. Here again, it will be appreciated that resistance to leakage gas is increased by reason of the circuitous path through the platform.

Figure 6:
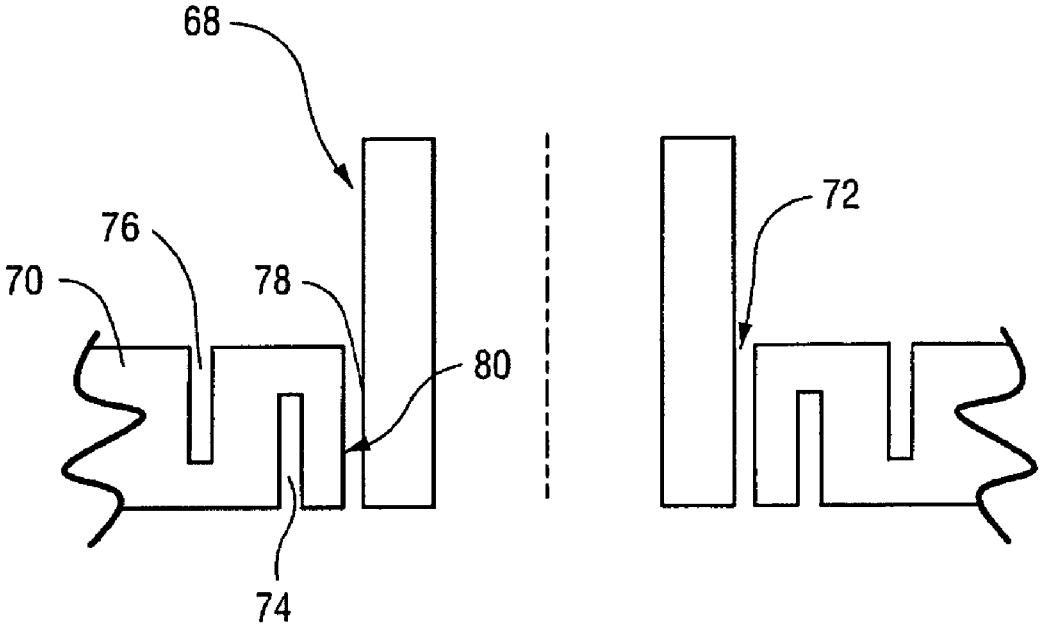
FIG. 6 is a schematic illustrating a compliant interface between a CMC airfoil shell and an inner metal platform in accordance with a fourth exemplary embodiment of the invention.
Figure 7:
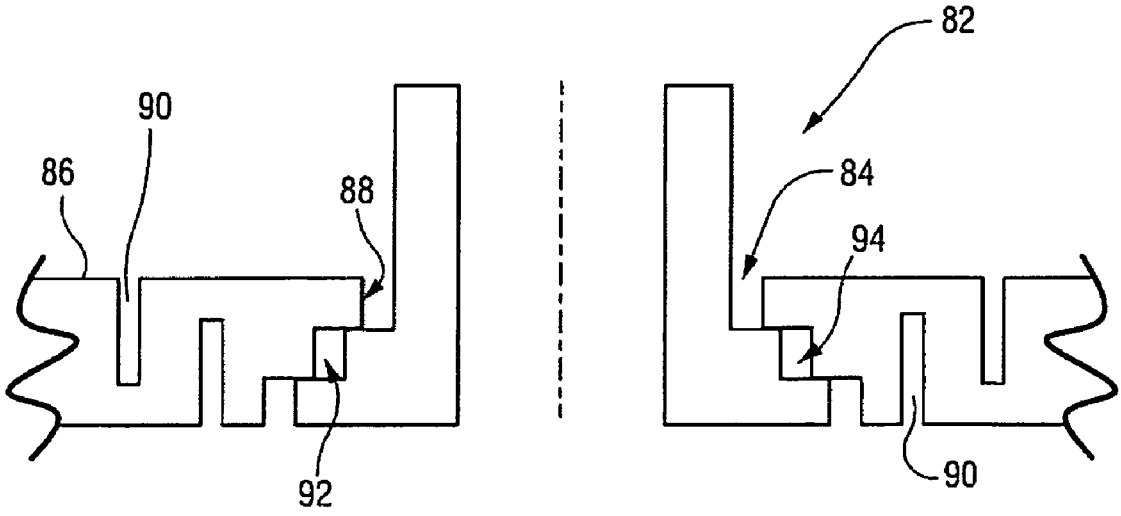
FIG. 7 is a schematic of a combined compliant/step joint interface between a CMC airfoil shell and an inner metal platform in accordance with a fourth exemplary embodiment of the invention.

In FIG. 6, a compliant interface is provided between a CMC airfoil shell 68 and an inner metal platform 70. In this embodiment, the recess 72 in the inner platform is formed with a peripheral edge having oppositely directed cutouts or slots 74, 76 extending in a radial direction that, in effect, permit the edge 80 of the recess 72 to act in the nature of a spring, in compliant or resilient "engagement" (i.e., with minimal clearance) with an adjacent smooth surface 78 of the airfoil shell. In order to incorporate the circuitous leakage gas feature of the earlier-described embodiments, it will be appreciated that the edge 80 of the platform recess 72 may be configured to incorporate a step joint as illustrated in FIG. 3 or a scarf joint as illustrated in FIG. 4. These alternative interface configurations are shown schematically in FIGS. 7 and 8, respectively. Specifically, FIG. 7 shows a compliant step joint where the CMC airfoil shell 82 is seated within the recess 84 in an inner metal platform 86, with the edge 88 of the compliant recess (formed by slots 90) formed with a step joint 92 that interfaces with a complementary step joint 94 on the airfoil shell.

Figure 8:
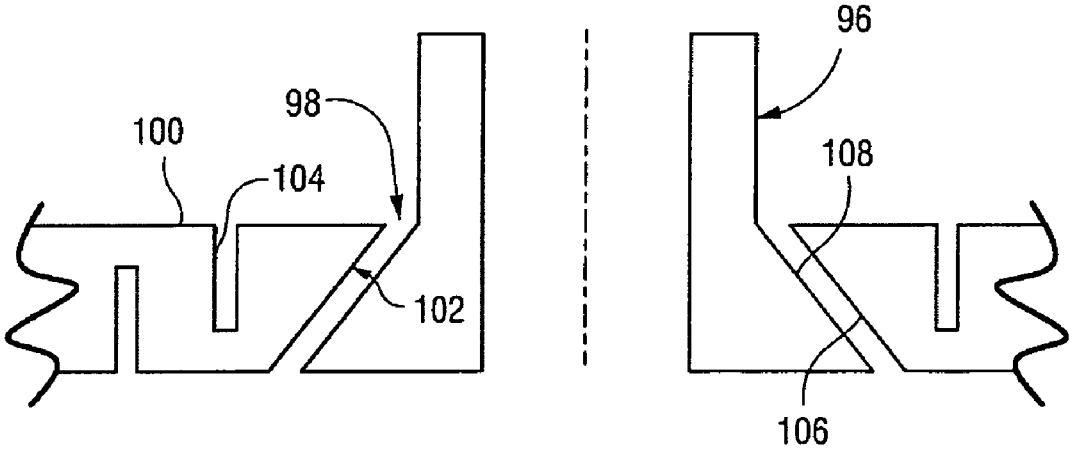
FIG. 8 is a schematic of a combined compliant scarf joint interface between a CMC airfoil shell and an inner metal platform in accordance with a fifth exemplary embodiment of the invention.

In FIG. 8, the CMC airfoil shell 96 is seated within the recess 98 in an inner metal platform 100, with the edge 102 of the recess 84 (formed by slots 104) formed with an angled surface 106 that interfaces with a complementary angled peripheral surface 108 on the airfoil shell 96, thus forming a compliant scarf joint at the interface.

By providing increased flow resistance resulting in controlled leakage, it is possible to eliminate the steep thermal gradients and associated reduction in thermal stresses and increased component life; thinner wall sections of the CMC vane to the elimination of internal pressure due to cooling air; and robust consistent performance by eliminating seal degradation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A stator vane assembly for a gas turbine comprising a ceramic matrix composite airfoil held between radially inner and outer metal platforms wherein a seal-less interface between said airfoil and at least one of said radially inner and outer platforms is shaped to create a circuitous leakage path for gas from the gas turbine.

2. The stator vane assembly of claim 1 wherein said interface comprises mating stepped surfaces.

3. The stator vane assembly of claim 2 wherein said mating stepped surfaces include at least two steps perpendicular to a radial centerline through said vane.

4. The stator vane assembly of claim 1 wherein said interface comprises a mating scarf joint.

5. The stator vane assembly of claim 4 wherein said scarf joint includes mating surfaces at an angle of about 45° relative to a radial centerline through said vane.

6. The stator vane assembly of claim 1 wherein said interface comprises plural abradable knife edges on said radially inner platform adjacent a smooth surface on said airfoil.

7. The stator vane assembly of claim 6 wherein said plural abradable knife edges comprise at least four projections terminating in radial surfaces adjacent said smooth surface on said airfoil.

8. The stator vane assembly of claim 1 wherein said interface is located at said radially inner platform.

9. A stator vane assembly for a gas turbine comprising a ceramic matrix composite airfoil held in seal-less fashion between radially inner and outer metal platforms wherein at least one of said platforms is formed with a recess adapted to receive said airfoil, said recess including a peripheral edge, said peripheral edge shaped to create a circuitous leakage path in cooperation with an adjacent surface on said airfoil.

10. The stator vane assembly of claim 9 wherein said adjacent airfoil surface is smooth.

11. The stator vane assembly of claim 9 wherein said peripheral edge is shaped to include a first plurality of steps and said adjacent surface on said airfoil is shaped to include a second plurality of complementary steps.

12. The stator vane assembly of claim 11 wherein said first plurality of steps include at least two steps perpendicular to a radial centerline through said vane.

13. The stator vane assembly of claim 9 wherein said peripheral edge is shaped to include a scarf joint comprising first angled surface and said adjacent surface on said airfoil is shaped to include a second complementary angled surface.

14. The stator vane assembly of claim 13 wherein said scarf joint includes mating surfaces at an angle of about 45° relative to a radial centerline through said vane.

15. The stator vane assembly of claim 9 wherein said peripheral edge comprises plural abradable knife edges on said radially inner platform adjacent a smooth surface on said airfoil.

16. A stator vane assembly for a gas turbine comprising a ceramic matrix composite vane held between radially inner and outer metal platforms wherein a seal-less interface between said vane and at least one of said radially inner and outer platforms is shaped to provide a compliant face for engagement with a smooth surface on said vane.

17. The stator vane assembly of claim 16 wherein at least said radially inner platform is formed with an inner recess, that receives said stator vane, said inner recess having a peripheral edge; and a plurality of oppositely directed radial slots adjacent said peripheral edge.

18. The stator vane assembly of claim 17 wherein said peripheral edge of said inner recess is also formed with a surface shaped to create a circuitous leakage path for gas from the gas turbine hot gas path.

19. The stator vane assembly of claim 18 wherein said edge comprises one of a stepped or angled surface adapted to engage a respective complementary stepped or angled surface on said ceramic matrix composite vane.

* * * * *